US006651587B1

(12) United States Patent
DeFord et al.

(10) Patent No.: US 6,651,587 B1
(45) Date of Patent: Nov. 25, 2003

(54) CONTAINER FOR CONTAINING AN EXPERIMENTAL TEST ANIMAL

(75) Inventors: Henry S. DeFord, Benton City, WA (US); John C. Blessing, West Richland, WA (US); Darryl R. Kimsey, West Richland, WA (US); Ruston L. Thomas, Richland, WA (US); Kenneth A. Williams, Richland, WA (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 10/113,433

(22) Filed: Mar. 29, 2002

(51) Int. Cl.[7] ..... A61D 7/04
(52) U.S. Cl. ..... 119/420
(58) Field of Search ..... 119/417, 420, 119/752; 24/273

(56) References Cited

U.S. PATENT DOCUMENTS

| | | | | |
|---|---|---|---|---|
| 2,490,180 A | | 12/1949 | Varnedoe, Jr. | |
| 3,739,751 A | * | 6/1973 | Mohr et al. | 119/752 |
| 3,984,936 A | | 10/1976 | Camp | 43/66 |
| 4,479,493 A | * | 10/1984 | Bung et al. | 128/204.18 |
| 4,721,060 A | | 1/1988 | Cannon et al. | |
| 4,860,741 A | | 8/1989 | Bernstein et al. | |
| 5,099,792 A | | 3/1992 | Cannon et al. | |
| 5,297,502 A | | 3/1994 | Jaeger | |
| 5,320,069 A | | 6/1994 | Anderson, Jr. et al. | 119/751 |
| 5,979,105 A | | 11/1999 | Marks | 43/61 |
| 6,105,212 A | * | 8/2000 | Wright | 24/273 |
| 6,178,686 B1 | | 1/2001 | Batman | 43/61 |

FOREIGN PATENT DOCUMENTS

| | | | |
|---|---|---|---|
| EP | 0273010 A1 * | 6/1988 | 119/420 |

OTHER PUBLICATIONS

CH Technologies, Inc. website, Animal Holders page: http://www.toxics.com; accessed Mar. 11, 2002.

* cited by examiner

*Primary Examiner*—Robert P. Swiatek
(74) *Attorney, Agent, or Firm*—MacMillan, Sobanski & Todd, LLC

(57) ABSTRACT

A container for containing an experimental test animal includes a body portion. A neck extends from a first end of the container for connecting the container to a source of gaseous material. An inner surface defines an opening at a second end of the container. An insert is removably retained within the neck, and has passage for fluid communication between the source of gaseous material and the container. A retainer is mounted within the opening of the container, and includes a retainer body and a retainer neck extending from the outer edge of the retainer body. A camming member is pivotally mounted to the retainer neck and is shaped to releasably engaging an outer surface of the container. A mounting ridge is formed in an outer surface of the body portion. The mounting ridge includes a retaining surface for mounting the container with respect to the source of gaseous material.

26 Claims, 5 Drawing Sheets

CONTAINER FOR CONTAINING AN EXPERIMENTAL TEST ANIMAL

BACKGROUND OF THE INVENTION

This invention relates to a container for containing an experimental test animal. More specifically, this invention relates to a tube for containing a rodent.

In many environmental and medical studies, it is necessary to conduct experiments involving the supply of gas or aerosol to experimental test animals. Rodents, such as rats, and also much smaller animals, such as mice, are frequently used for this purpose.

It is often desired to confine the aerosol or gas to the noses of the animals to restrict the dose of gas solely to the respiratory system of the animal. This is typically accomplished by so-called "nose-only exposure devices." Containers, such as rodent restraint tubes are commonly used to restrain animals during exposure to inhaled atmospheres while the tube is mated to such a nose-only exposure device.

Known tubes typically include protrusions or a mounting bracket for attachment to a nose-only exposure device. Such mounting brackets are known to snag and damage protective gloves and to snag each other when placing and removing groups of tubes from wash baskets. Known tubes also typically include a retainer for closing an open back end of the tube, and retaining the animal therein. Typical retainers include a locking mechanism. It is also known to provide tubes with a small diameter nozzle or neck for receiving the nose of an experimental test animal. Openings in such necks are often too large to satisfactorily retain the head of an animal, and must therefore be provided with holes for receiving pins. The pins reduce the size of the opening in the neck and prevent small animals from escaping or sealing the opening in the neck. Such pin receiving holes are typically drilled through the neck after manufacture of the container and often weaken the neck, resulting in broken container necks. Accordingly, it would desirable to provide improved rodent restraint tubes.

SUMMARY OF THE INVENTION

The invention relates to a container for containing an experimental test animal. The container includes a body portion. A neck extends from a first end of the container for connecting the container to a source of gaseous material. An inner surface defines an opening at a second end of the container. An insert is removably retained within the neck, and has a passage for fluid communication between the source of gaseous material and the container.

In another embodiment of the invention, the container includes a body portion having an opening and a longitudinal slot. A neck extends from a first end of the container for connecting the container to a source of gaseous material. An inner surface defines an opening at a second end of the container. A retainer is mounted within the opening of the container, and includes a retainer body. The retainer body has an outer edge substantially conforming to the shape of the opening of the container. A retainer neck extends from the outer edge of the retainer body and is inserted within the longitudinal slot of the body portion. A camming member is pivotally mounted to the retainer neck, and is shaped to releasably engage an outer surface of the container.

In another embodiment of the invention, the container includes a retainer mounted within the opening of the container. The retainer includes a retainer body. The retainer body has an axis substantially parallel to the longitudinal axis of the container and an outer edge substantially conforming to the shape of the opening of the container. A retainer neck extends from the outer edge of the retainer body and is inserted within the longitudinal slot of the body portion. A locking mechanism is attached to the retainer neck and has a pin slot transverse to the axis of the retainer body. The locking mechanism includes a pin within the pin slot. Means for urging the pin into frictional engagement with the body portion of the container is provided. A handle is pivotally mounted to the locking mechanism for actuating the urging means.

In another embodiment of the invention, a container for containing an experimental test animal with respect to a source of gaseous material is provided. The container includes a body portion. A neck extends from a first end of the container for connecting the container to the source of gaseous material. An inner surface defines an opening at a second end of the container. A mounting ridge is provided in an outer surface of the body portion. The mounting ridge has a retaining surface for mounting the container with respect to the source of gaseous material.

Various objects and advantages of this invention will become apparent to those skilled in the art from the following detailed description of the preferred embodiment, when read in light of the accompanying drawings.

DETAILED DESCRIPTION OF THE INVENTION

Figure 1:
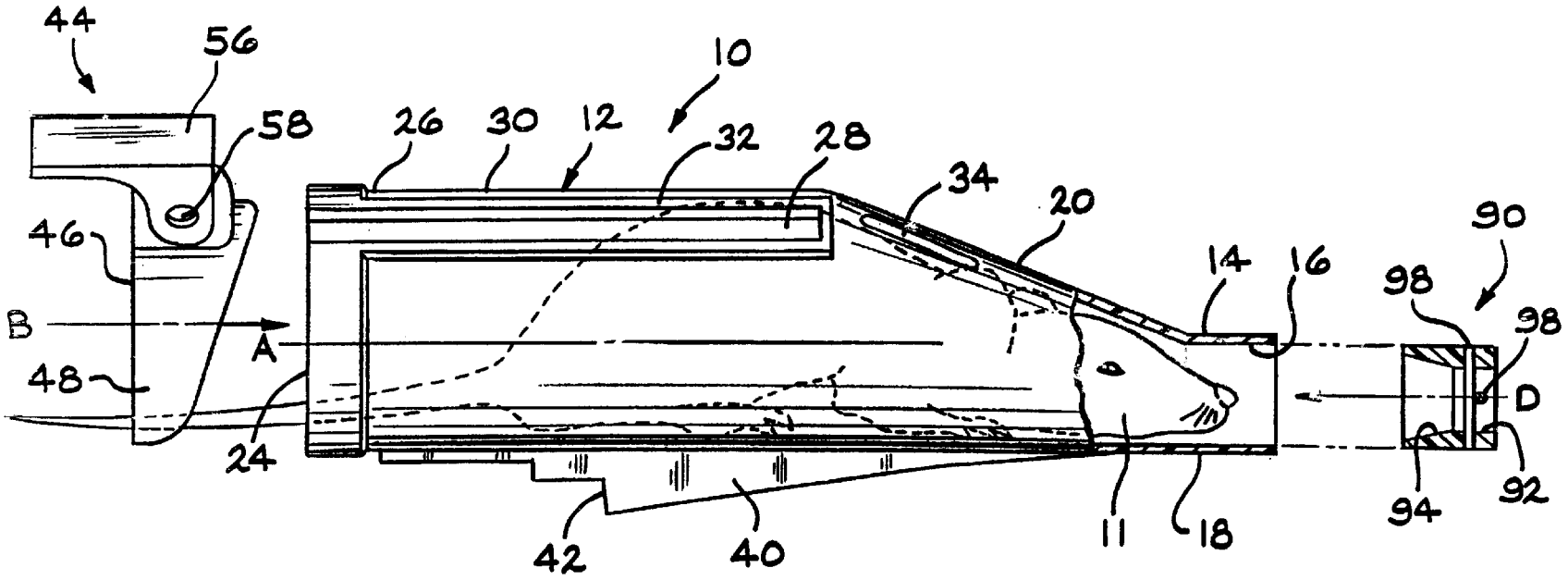
FIG. 1 is an expanded elevational view, partially in cross section, of a container for containing an experimental test animal according to the invention.
Figure 2:
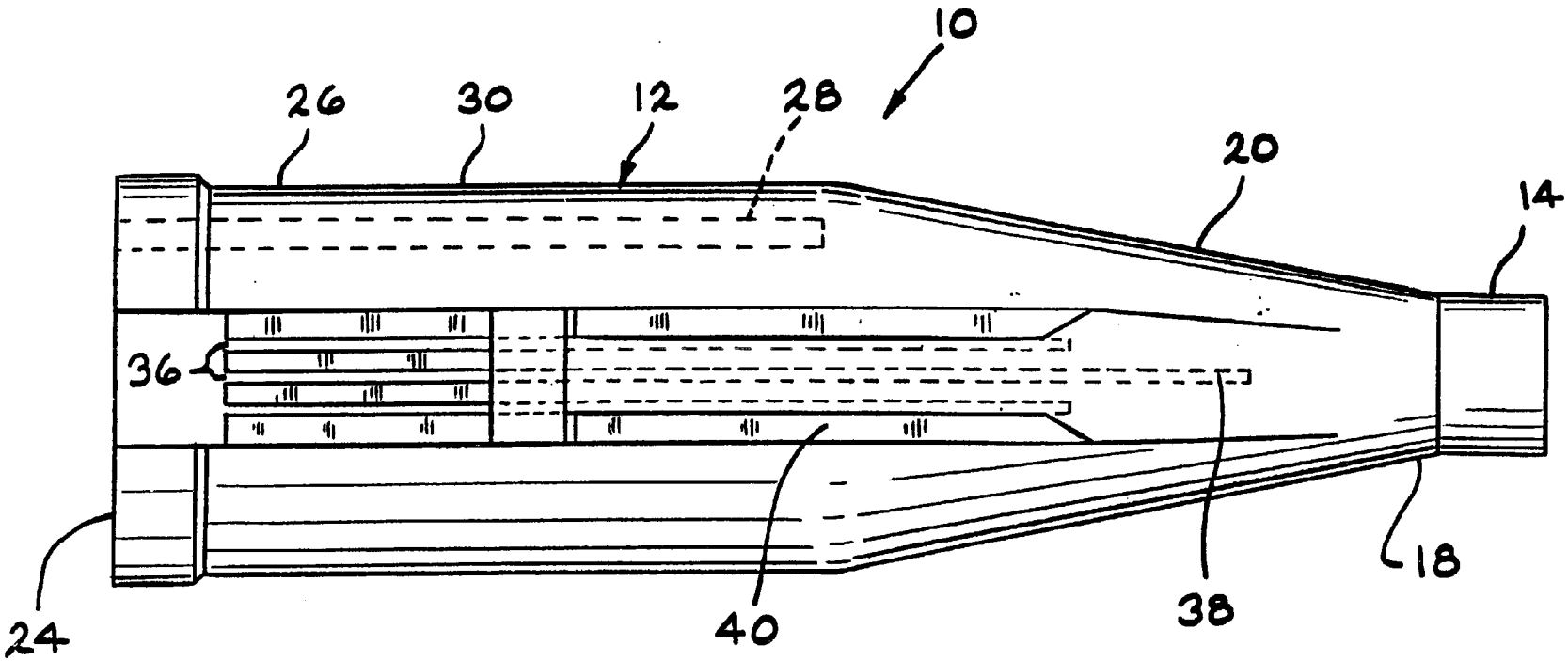
FIG. 2 is a bottom view of the container of FIG. 1.
Figure 3:
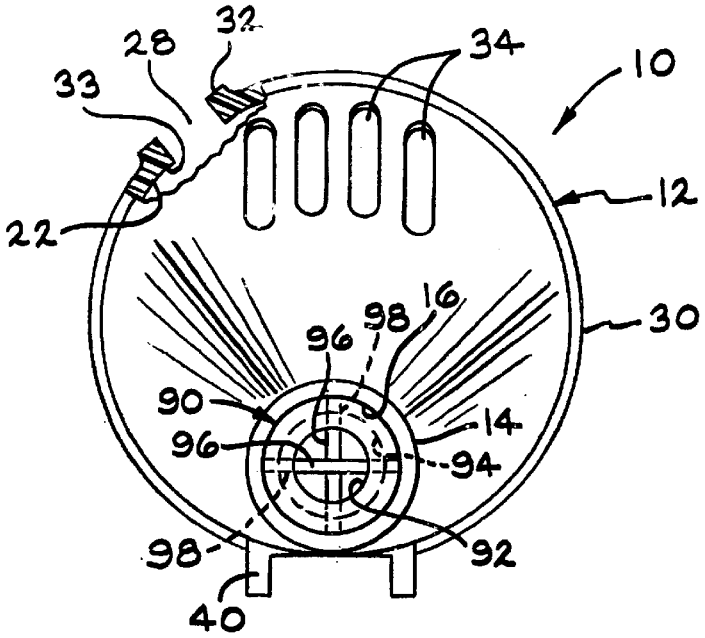
FIG. 3 is an end view, partially in cross section, of the container of FIG. 1 showing the insert within the neck.

Referring now to the drawings, there is illustrated in FIGS. 1 through 3 a container 10 for containing an experimental test animal 11, such as a rodent. The container 10 includes a body portion 12, and a neck 14. The neck 14 defines a neck opening 16 and extends from a first end 18 of the container 10. The container 10 also includes a tapered portion 20 between the body portion 12 and the neck 14. An innersurface 22 of the body portion 12 defines a substantially cylindrical opening 24 at a second end 26 of the container 10. A longitudinal slot 28 is formed in the body portion 12 and extends from the second end 26 of the container toward the tapered portion 20.

A plurality of slots 34 for ventilation to the atmosphere is formed in the tapered portion 20 of the container 10. A plurality of waste slots 36 for removal of animal excrement to a collection container (not shown) is formed in the body portion 12 of the container 10. A waste channel or groove 38 is formed in the inner wall of the container 10 and extends from each waste slot 36 toward the first end 18 of the container 10. In the embodiment illustrated, four ventilation slots 34, and three waste slots 36 are shown. However, it will be appreciated that the container 10 may be formed with any suitable number of ventilation slots 34 and any suitable number of waste slots 36.

A mounting ridge 40, substantially parallel with a longitudinal axis A of the container 10, is formed on the outer surface 30 of the container 10. The mounting ridge 40 includes a retaining surface 42. Preferably, the retaining surface 42 is substantially transverse to the axis A of the container 10. The retaining surface 42 provides a surface for receiving a device, such as a wire support, for attaching the container 10 to a source of gaseous material (not shown). Preferably, the retaining surface 42 is received within a groove of an apparatus (not shown) for supporting one or more containers 10 relative to the source of gaseous material. Preferably, the mounting ridge 40 is tapered from the first end 18 of the container 10, and has a substantially smooth surface, thereby reducing snagging or tearing of protective gloves worn by a person handling the container 10. Preferably, the length of the mounting ridge 40 is at least about 25 percent of a length of the container 10. More preferably, the length of the mounting ridge 40 is at least about 40 percent of the length of the container 10. The container 10 may be formed of any suitable material. Preferably, the container 10 is formed of a transparent polymer, such as polycarbonate or polystyrene.

Figure 4:
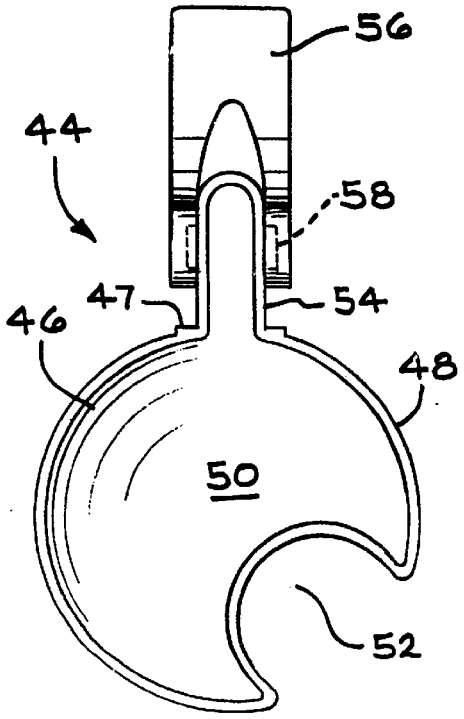
FIG. 4 is a front view of the retainer of FIG. 1.
Figure 5:
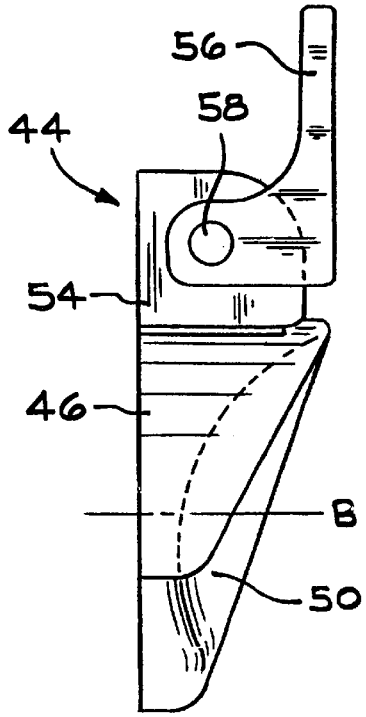
FIG. 5 is a side view of the retainer of FIG. 4.

As shown in FIGS. 1, 4, and 5, a back restraint or retainer 44 is also provided. The retainer 44 includes a retainer body 46 having an axis B substantially parallel to the axis A of the container 10, and an outer edge 48 substantially conforming to the shape of the opening 24 in the second end 26 of the container 10. The retainer body 46 may be of any suitable shape for insertion into, and mounting within the container 10, such as disk shaped. Preferably, the retainer body 46 is of a type commonly known in the art, and has a substantially concave surface 50 for contacting the rump of the experimental test animal 11. The retainer body 46 typically includes an opening 52 for receiving the tail of the animal 11. A retainer neck 54 extends outwardly from the outer edge 48 of the retainer body 46, and is configured for insertion within the longitudinal slot 28 of the body portion 12. Preferably, retainer engagement surfaces 47 are formed adjacent the retainer neck 54.

A camming member 56 is pivotally mounted to the retainer neck 54 by a first pivot pin 58. The camming member 56 is shaped such that, when the retainer neck 54 is inserted within the longitudinal slot 28, the camming member 56 releasably engages the outer surface 30 of the body portion 12 of the container 10. For example, when engaging the body portion 12 of the container 10, the camming member 56 is in a first position as shown in FIG. 1. When moved to a second position, as shown in FIGS. 4 and 5, the camming member 56 is disengaged from the body portion 12 of the container 10, thereby allowing the retainer 44 to be inserted, or removed from, the opening 24 of the container 10.

Preferably, an outer surface 30 of the body portion 12 includes first engagement surfaces 32 formed adjacent the slot 28. Similarly, the inner surface 22 of the body portion 12 includes second engagement surfaces 33 formed adjacent the slot 28. Preferably, the camming member 56 releasably engages the first engagement surfaces 32 when the camming member 56 is in the first position. In a similar manner, the engagement surface 47 of the retainer 44 frictionally engages the second engagement surfaces 33. It will be understood that satisfactory mounting of the retainer 44 within the container 10 may be achieved by a container wherein the inner surface 22 and the outer surface 30 are formed without the engagement surfaces 33 and 32, respectively.

Figure 6:
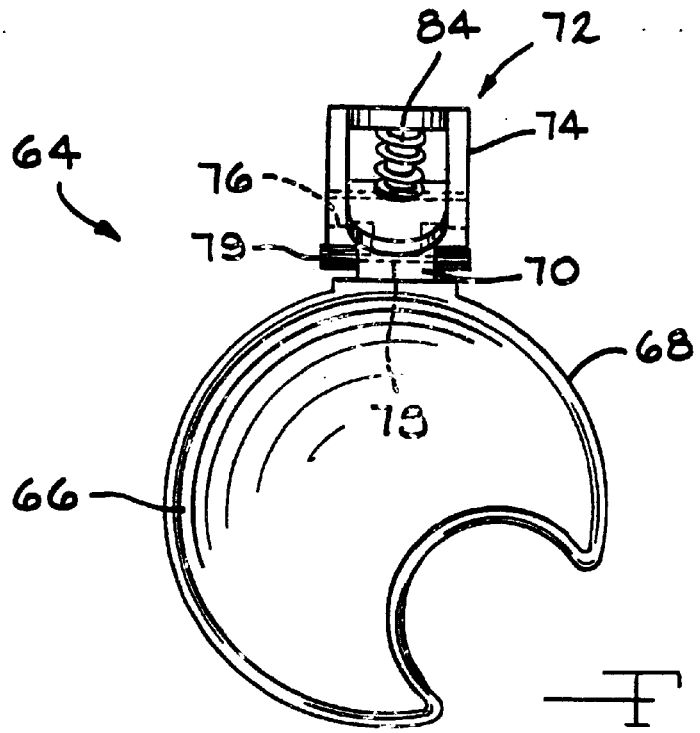
FIG. 6 is a front view of an alternate embodiment of the retainer.
Figure 7:
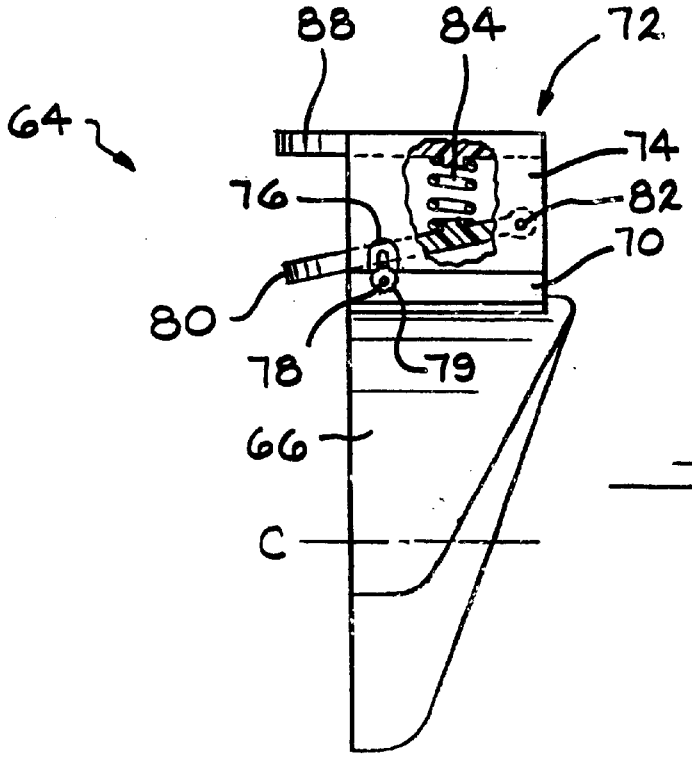
FIG. 7 is a side view of the alternate embodiment of the retainer of FIG. 6.

An alternate embodiment of the retainer is shown generally at 64 in FIGS. 6 and 7. The retainer body 66 of the retainer 64 is similar to the retainer body 46 of the retainer 44 and includes a longitudinal axis C and outer edge 68. However, the retainer 64 includes a retainer neck 70 which extends outwardly from the outer edge 68 of the retainer body 66. The retainer neck 70 is configured for insertion within the longitudinal slot 28 of the body portion 12. The retainer 64 includes a locking mechanism 72 attached to the retainer neck 70.

The locking mechanism 72 includes a housing 74. A pin slot 76 is formed in the housing 74 and is arranged transverse to the axis C of the retainer body 66. The locking mechanism 72 includes a dog or pin 78 within the pin slot 76 of the housing 74. Preferably, the pin 78 includes engaging portions 79 at the outer ends thereof for frictional engagement with the body portion 12 of the container 10. Preferably, a first handle 80 is pivotally mounted to the housing 74 by a second pivot pin 82.

Figure 8:
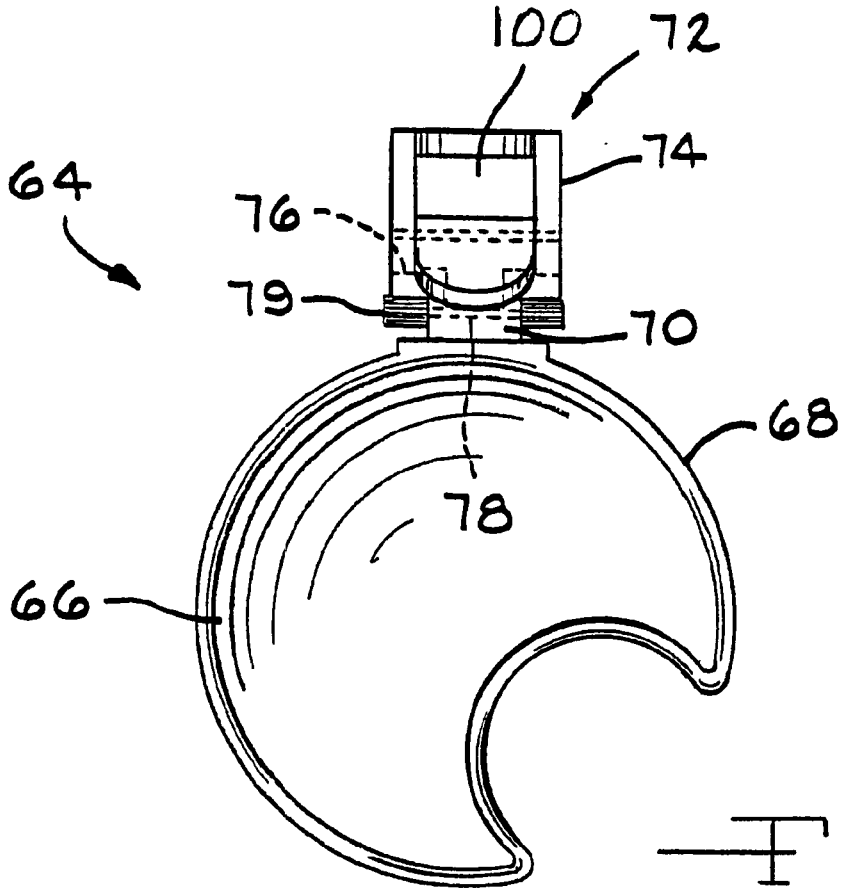
FIG. 8 is a front view of another alternate embodiment of the retainer.

Any suitable means for urging the pin 78 and engaging portions 79 into frictional engagement with the body portion 12 of the container 10 may be provided. Such means for urging may include, for example, compression springs, extension springs, torsion springs, disk springs, spring washers, elastomeric members, elector magnetic members, magnetic members, such as the magnetic member 100 schematically illustrated in FIG. 8, and the like. Preferably, a compression spring 84 is disposed within the housing 74 of the locking mechanism 72 between the handle 80 and an upper surface 86 of the housing 74. The spring 84 urges the first handle 80 downwardly (as viewed in FIG. 7), thereby urging the pin 78 into frictional engagement with the body portion 12 of the container 10. The locking mechanism 72 may also include a second handle 88 rigidly attached to the upper surface 86 of the housing 74. The locking mechanism 72 may thereby be easily operated by an operator using only one hand.

As shown in FIGS. 1 and 3, an insert 90 may also be provided. Preferably, the insert 90 has substantially cylindrical shape corresponding to the shape of an inner surface of the neck 14 of the container 10. The insert 90 has a longitudinal axis D, and includes a passage 92 for fluid communication between the source of gaseous material and the container 10. Preferably, the passage 92 is substantially smaller than the head of the animal 11 contained within the container 10. Preferably, the passage 92 is substantially cylindrical. More preferably, a portion 94 of the passage 92 is substantially tapered.

The insert 90 is remiovably retained within the neck 14 by any suitable method, such as by friction or interference fit. One or more insert pins 96 may be inserted into pin-receiving holes 98 formed in the insert 90 to reduce size of insert passage 92. The pin receiving holes 98 may be formed during manufacture of the inserts 90, or may be formed in an insert 90 by any conventional method, such as drilling. Preferably, the insert pins 96 are oriented transverse to the longitudinal axis D of the insert 90, thereby reducing the size of the insert passage 92 and preventing the animal 11 from extending its head beyond the insert pins 96.

The retainers 44 and 64, and the insert 90 may be made of any suitable material such as glass or plastic. A preferable material is polyphenylene oxide (PPO). More preferably, retainers 44 and 64, and insert 90 are made of polyphenylene oxide-styrene, such as Noryl (a registered trademark of the General Electric Company).

The principle and mode of operation of this invention have been described in its preferred embodiments. However, it should be noted that this invention may be practiced otherwise than as specifically illustrated and described without departing from its scope.

What is claimed is:

1. A container for containing an experimental test animal comprising:

a body portion;

a neck extending from a first end of the container for connecting the container to a source of gaseous material, wherein the neck is substantially cylindrical and extends from a tapered portion of the body portion;

an inner surface defining an opening at a second end of the container; and an insert removably retained within the neck, the insert having a passage for fluid communication between the source of gaseous material and the container.

2. The container defined in claim 1 wherein the neck has a substantially cylindrical inner surface, and the insert has a substantially cylindrical shape corresponding to the shape of the inner surface of the neck.

3. The container defined in claim 1 wherein the passage of the insert is substantially cylindrical.

4. The container defined in claim 1 wherein a portion of the passage of the insert is substantially tapered.

5. The container defined in claim 1 wherein at least one elongate pin is attached to the insert, the pin being substantially transverse to a longitudinal axis of the insert passage, the pin reducing the size of the insert passage.

6. The container defined in claim 1 wherein the insert is removably retained within the neck.

7. A container for containing an experimental test animal comprising:

a body portion having an opening and a longitudinal slot;

a neck extending from a first end of the container for connecting the container to a source of gaseous material;

an inner surface defining an opening at a second end of the container; and a retainer mounted within the opening of the container, the retainer including a retainer body, the retainer body having an outer edge substantially conforming to the shape of the opening of the container, a retainer neck extending from the outer edge of the retainer body, the retainer neck being inserted within the longitudinal slot of the body portion, and a camming member pivotally mounted to the retainer neck, the camming member shaped to releasably engage an outer surface of the container.

8. A container for containing an experimental test animal, the container having a longitudinal axis, the container comprising:

a body portion having an opening and a longitudinal slot;

a neck extending from a first end of the container for connecting the container to a source of gaseous material;

an inner surface defining an opening at a second end of the container; and a retainer mounted within the opening of the container, the retainer including a retainer body, the retainer body having an axis substantially parallel to the longitudinal axis of the container, and an outer edge substantially conforming to the shape of the opening of the container, a retainer neck extending from the outer edge of the retainer body, the retainer neck being inserted within the longitudinal slot of the body portion, and a locking mechanism having a pin slot transverse to the axis of the retainer body, the locking mechanism being attached to the retainer neck and including a pin within the, pin slot, means for urging the pin into frictional engagement with the body portion of the container, and a handle pivotally mounted to the locking mechanism, the handle for actuating the urging means.

9. The container defined in claim 8 wherein the urging means is a spring.

10. The container defined in claim 8 wherein the urging means is a compression spring.

11. The container defined in claim 8 wherein the urging means is an extension spring.

12. The container defined in claim 8 wherein the urging means is an elastomeric member.

13. The container defined in claim 8 wherein the urging means is a magnetic member.

14. A container for containing an experimental test animal with respect to a source of gaseous material, the container comprising:

a body portion;

a neck extending from a first end of the container for connecting the container to the source of gaseous material;

an inner surface defining an opening at a second end of the container; and a mounting ridge in an outer surface of the body portion, the mounting ridge having a retaining surface, the retaining surface for mounting the container with respect to the source of gaseous material.

15. The container defined in claim 14 wherein the retaining surface of the mounting ridge is substantially transverse to a longitudinal axis of the container.

16. In combination:

a container for containing an experimental test animal; and a retainer sized to fit within an opening in the container, the retainer including:

a retainer body having an outer edge substantially conforming to the shape of the opening in the container;

a retainer neck extending from the outer edge of the retainer body; and a camming member pivotally mounted to the retainer neck, the camming member shaped to releasably engage an outer surface of the container.

17. A retainer suitable for insertion into a container for containing an experimental test animal, the container having a longitudinal axis, the retainer comprising:

a retainer body having an axis substantially parallel to the longitudinal axis of a container and an outer edge substantially conforming to the shape of an opening in the container;

a retainer neck extending from the outer edge of the retainer body; and a locking mechanism having a pin slot transverse to the axis of the retainer body, the locking mechanism being attached to the retainer neck and including a pin within the pin slot, means for urging the pin into frictional engagement with the container, and a handle pivotally mounted to the locking mechanism, the handle for actuating the urging means.

18. In combination:

a container for containing an experimental test animal; and an insert adapted to be inserted into an opening in the container for containing an experimental test animal, the container connected to a source of gaseous material, the insert comprising a body, the body having a passage for fluid communication between the source of gaseous material and the container, the insert positioned in the opening in the container wherein a portion of the passage of the insert is substantially tapered.

19. The insert defined in claim 18 wherein at least one elongate pin is attached to the insert, the pin being substantially transverse to a longitudinal axis of the insert passage, the pin reducing the size of the insert passage.

20. The insert defined in claim 18 wherein the insert is removably retained within the opening of the container.

21. A container for containing an experimental test animal comprising:

a body portion;

a neck extending from a first end of the container for connecting the container to a source of gaseous material;

an inner surface defining an opening at a second end of the container; and an insert removably retained within the neck, the insert having a passage for fluid communication between the source of gaseous material and the container, wherein the passage of the insert is substantially tapered.

22. The container defined in claim 21 wherein the neck is substantially cylindrical and extends from a tapered portion of the body portion.

23. The container defined in claim 21 wherein the neck has a substantially cylindrical inner surface, and the insert has a substantially cylindrical shape corresponding to the shape of the inner surface of the neck.

24. The container defined in claim 21 wherein a portion of the passage of the insert is substantially cylindrical.

25. The container defined in claim 21 wherein at least one elongate pin is attached to the insert, the pin being substantially transverse to a longitudinal axis of the insert passage, the pin reducing the size of the insert passage.

26. The container defined in claim 21 wherein the insert is removably retained within the neck.

* * * * *